US006347201B1

(12) United States Patent
Sano et al.

(10) Patent No.: US 6,347,201 B1
(45) Date of Patent: Feb. 12, 2002

(54) IMAGE HEATING APPARATUS

(75) Inventors: Tetsuya Sano; Masao Umezawa, both of Shizuoka-ken; Hideo Nanataki, Yokohama; Takao Kume, Mishima; Takashi Nomura, Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/621,829

(22) Filed: Jul. 21, 2000

(30) Foreign Application Priority Data

Jul. 23, 1999 (JP) ..... 11-208814
Jul. 11, 2000 (JP) ..... 2000-210209

(51) Int. Cl.[7] ..... G03G 15/20

(52) U.S. Cl. ..... 399/67; 219/216; 219/243; 399/328

(58) Field of Search ..... 399/67, 69, 70, 399/328, 329; 219/216, 243; 347/156

(56) References Cited

U.S. PATENT DOCUMENTS 5,148,226 A * 9/1992 Setoriyama et al. ..... 399/329
5,543,904 A 8/1996 Kato et al. ..... 399/335
5,742,878 A * 4/1998 Kuroda ..... 399/329 X
5,881,349 A 3/1999 Nanataki et al. ..... 399/328
6,031,215 A 2/2000 Nanataki et al. ..... 219/619
6,049,691 A 4/2000 Abe et al. ..... 399/330
6,072,964 A * 6/2000 Abe et al. ..... 399/69
6,094,559 A * 7/2000 Otsuka et al. ..... 399/69 X
6,263,172 B1 * 7/2001 Suzuki et al. ..... 399/67

FOREIGN PATENT DOCUMENTS

JP 63-313182 12/1988
JP 2-157878 6/1990
JP 4-44075 2/1992
JP 4-204980 7/1992
JP 04-337778 * 11/1992
JP 7-114276 5/1995

* cited by examiner

*Primary Examiner*—Sophia S. Chen
(74) *Attorney, Agent, or Firm*—Fitzpatrick, Cella, Harper & Scinto

(57) ABSTRACT

An image heating apparatus has a first member; a second member slidable relative to the first member; a third member for forming a nip with the first member with the second member disposed therebetween, wherein a recording material carrying an image is nipped and red by the nip between the second member and the third member, a pressure control unit for controlling a pressure at the nip to set the pressure to a first pressure and a second pressure which is higher than the first pressure, wherein when the second member starts moving upon start of image heating operation, the control unit sets the pressure to the first pressure and then to the second pressure.

22 Claims, 10 Drawing Sheets

IMAGE HEATING APPARATUS

FIELD OF THE INVENTION AND RELATED ART

The present invention relates to an image heating apparatus used with an image forming apparatus such as a copying machine, a printer, and the like. In particular, it relates to an image heating apparatus in which a second member, such as a piece of film or the like, slides on a first member.

For ease of description, the present invention will be described with reference to a fixing apparatus, with which an image forming apparatus, for example, a copying machine, a printer, or the like, is provided, and which thermally fixes a toner image to a piece of recording medium.

In an image forming apparatus, an image (unfixed toner image) is formed through an optional image forming process, for example, an electrophotographic process, an electrostatic recording process, a magnetic recording process, or the like, and is directly placed, or indirectly placed (transferred) onto a piece of recording medium (transfer sheet, electro-fax sheet, electrostatic recording sheet, OHP sheet, printing sheet, format sheet, and the like). The unfixed toner image placed on the recording medium is thermally fixed, as a permanent image, to the surface of the recording medium by a fixing apparatus. As for such a fixing apparatus, a heat roller type fixing apparatus has been widely used.

In recent years, a film heating type fixing apparatus which employs a heater has been put to practical use, in view of quick starting and energy saving. Also, an film heating type fixing apparatus which uses an electromagnetic induction heating system has been proposed.

A film heating type fixing apparatus has been proposed in various Japanese official patent gazettes, for example, Japanese Laid-open Patent Application Nos. 313,182/1985, 157,878/1990, 44,075/1992, and 204,980/1992.

Generally speaking, a film heating type fixing apparatus is a fixing apparatus which comprises a ceramic heater as a heating member, a pressure roller as a pressure applying member, and a piece of heat resistant film (fixing film) placed between the ceramic heater and pressure roller. The ceramic heating member is pressed upon the pressure roller, with the fixing film being between them, to form a fixing nip. In operation, a piece of recording medium, on or onto which on unfixed toner image, that is, the image to be fixed, has been formed or transferred, is introduced into the fixing nip, and put through the nip together with the fixing film. As the recording medium is put through the fixing nip, the heat from the ceramic heating member, along with the pressure from the pressure roller, is applied to the recording medium through the fixing film. As a result, the unfixed toner image on the recording medium is fixed to the recording medium.

This film heating system makes it possible to realize an on-demand type fixing apparatus, which employs a ceramic heater, and a piece of film with low thermal capacity, and in which electrical power is applied to the ceramic heater to obtain the fixing temperature, only during the image formation by an image forming apparatus. An on-demand type fixing apparatus is advantageous in that the time is short from when the image forming apparatus is turned on to when the image forming apparatus becomes ready for image formation (it starts quickly), and is drastically smaller in the power consumption during a standby period (energy saving).

In Japanese Laid-open Patent Application No. 114,276/1995, an induction heating type fixing apparatus is disclosed, in which electrical current is induced in a piece of fixing film to generate heat therein (Joule heat). With this arrangement, heat is directly generated within the film, with the use of the induction current generated within the film, making it possible to realize a fixing process with a much higher efficiency than those of conventional fixing processed.

As for the method for driving the fixing film of a film heating type fixing apparatus, there has been devised a method in which the fixing film is rotationally driven by driving a pressure roller (pressure roller driving method), a method in which the fixing film is rotationally driven by a driver roller placed within the loop of the fixing film, and the like.

As for the pressure applying method, a generally used method is such that the fixing film is pinched between a film supporting member, such as the heater, or a film guide, disposed within the loop of the fixing film, and pressure is generated by a spring or the like placed, in the compressed state, between the pressure roller or the film supporting member (or a pressure application stay placed within the loop of the fixing film), and a spring seat.

However, there has been one object to be accomplished regarding a fixing apparatus which employed a film heating system such as the one described above, which was to improve the fixing film in terms of its slidableness against the film supporting member during the rotational driving of the fixing film.

More specifically, the object is to solve the problem that, if the pressure within the fixing nip is set relatively high to assure that a toner image is properly fixed to high gross paper, thick paper, or the like, the driving roller tends to fail to rotate, and therefore, the fixing film is not driven, during the starting-up of a fixing apparatus in a low temperature environment or the like. It is thought that this problem occurs because, not only is the higher pressure applied between the pressure roller and film supporting member, but also the slidableness of the fixing film against the film supporting member reduces in a low temperature environment, making it impossible for the amount of the torque which the driving roller can generate, to catch up with the torque necessary to rotationally drive the fixing film.

When the film failed to be moved, various problems occurred. For example, it took a longer time for the fixing apparatus to warm up, and/or the film was sometimes damaged due to the local increase of film temperature.

Further, the motor for driving the driving roller was subjected to an extra amount of external load generated on the film was prevented from being rotationally driven, and as a result, the motor sometimes failed. It was possible to employ a motor with a higher torque. But, such a measure led to the increase in the apparatus size and cost, and therefore, it was not the better way.

SUMMARY OF THE INVENTION

The primary object of the present invention is to provide an image heating apparatus capable of assuring that a second member smoothly slides against a first member even while the image heating apparatus is started up.

According to on aspect of the present invention, an image heating apparatus comprises a first member, a second member which slides against said first member, a third member which forms a nip against said first member, with the second member being disposed between the first and third members, and a pressure controlling means capable of providing two levels of pressure, that is, a first level, and a second level greater than the first level, in said nip, wherein an image borne on a piece of recording medium is heated while the piece of recording medium, on which an image has been borne, is conveyed through said nip, while being pinched between said second and third members, and wherein when said second member begins to be moved from its still state as an image heating operation is started, the pressure in said nip is set at the first level, and then, is switched to the second level.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferable embodiments of the present invention will be described with reference to the appended drawings.

Figure 12:
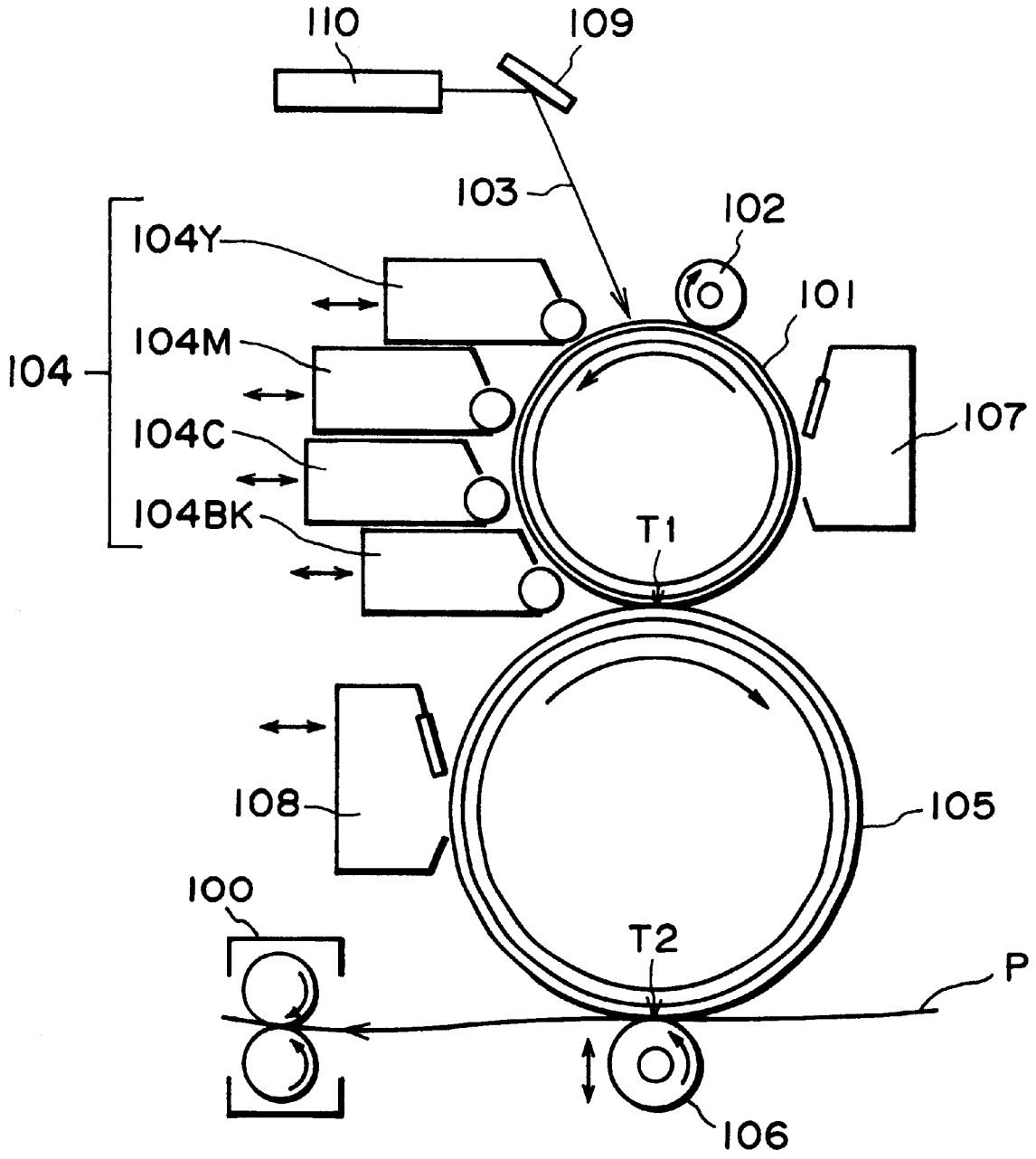
FIG. 12 is a schematic drawing of a typical image forming apparatus which employs an image heating apparatus.

FIG. 12 is a schematic drawing which shows a typical image forming apparatus which employs the image heating apparatus in one of the embodiments of the present invention. This image forming apparatus is a color laser printer which employs an electrophotographic process.

A referential code 101 designates a photosensitive drum as an image bearing member, for example, an organic photosensitive member, an amorphous silicon based photosensitive member, and the like, and is rotationally driven in the counterclockwise direction, indicated by an arrow mark, at a predetermined process speed (peripheral velocity).

As the photosensitive drum 101 is rotationally driven, it is uniformly charged the predetermined polarity and potential level by a charging apparatus 102 such as a charge roller.

Then, the charged surface of the photosensitive drum 101 is exposed to a laser beam 103 outputted in a scanning manner, while being modulated with image formation information, from a laser optics box (laser scanner) 110. More specifically, the laser optics box 110 scans the peripheral surface of the photosensitive drum 101 with the laser beam 103, which it outputs, while modulating (turning on or off) the beam 103 with sequential electric digital signals which reflect image formation information, and which are sent from an unillustrated image signal generating apparatus such as an image reading apparatus. As a result, an electrostatic latent image which reflects the image formation information is formed on the peripheral surface of the photosensitive drum 101. Designated by a referential code 109 is a mirror for deflecting the laser beam from the laser optics box 110, onto the specific points on the peripheral surface of the photosensitive drum 101 which are to be exposed.

In an image forming operation in which a full-color image is formed, a target image, that is, a full-color image, is separated into primary color components. First, a latent image which corresponds to a first color component, for example, yellow component, of the target image, is formed through the scanning exposure. The thus formed latent image is developed into an image formed of yellow toner (yellow toner image) through the operation of a yellow component developing device 104Y, which is one of the four color component developing devices 104. Then, the yellow toner image is transferred onto the peripheral surface of an intermediary transfer drum 105, in a primary transfer station T1, that is, the place where contact is made between the photosensitive drum 101 and intermediary transfer drum 105 (where the gap between the photosensitive drum 101 and intermediary transfer drum 105 is smallest). After the transfer of the toner image onto the peripheral surface of the intermediary transfer drum 105, the peripheral surface of the photosensitive drum 101 is cleaned by a cleaner 107; the residue, such as the toner which remains on the photosensitive drum 101 after the transfer, on the peripheral surface of photosensitive drum 101, is removed by the cleaner 107.

The above described process cycle which comprises the charging, scanning or exposing, developing, primary transferring, and cleaning processes is also carried out for a second component (for example, magenta component, for which a magenta component developing device 104M is operated), a third component (for example, cyan component, for which a cyan component developing device 104C, and a fourth component (for example, black component, for which a black component developing device 104BK is operated), in a sequential order. As a result, four color toner images, that is, a yellow toner image, a magenta toner image, a cyan toner image, and a black toner image, are sequentially placed in layers on the peripheral surface of the intermediary transfer drum 105, forming a full-color image of the target full-color image.

The intermediary transfer drum 105 comprises a metallic drum, an elastic layer placed on the peripheral surface of the metallic drum, and a surface layer coated on the elastic layer. The elastic layer has an intermediary electrical resistance, whereas the surface layer has a high electrical resistance. The intermediary transfer drum 105 is disposed so that its peripheral surface is placed actually or virtually in contact with the peripheral surface of the photosensitive drum 101. It is rotationally driven in the clockwise direction, indicated by an arrow mark, at the same peripheral velocity as the photosensitive drum 101, and bias, that is, difference in electrical potential level, is provided between the metallic drum of the intermediary transfer drum 105, and the photosensitive drum 101. As a result, the toner images on the photosensitive drum 101 are transferred onto the intermediary transfer drum 105 by the difference in electrical potential level.

The color toner images formed on the peripheral surface of the intermediary transfer drum 105 are transferred, in a secondary transfer station T2, that is, the contact nip between the intermediary transfer drum 105 and a transfer roller 106, onto the surface of a recording medium P sent into the secondary transfer station T2 from an unillustrated sheet feeding portion with predetermined timing. More specifically, the transfer roller 106 supplies the recording medium P with electrical charge, the polarity of which is opposite to that of the toner, from the back side of the recording medium P. As a result, the four color toner images, which synthetically form a single full-color image, are transferred together from the peripheral surface of the intermediary transfer drum 105 onto the recording medium P, starting from the leading end of the recording medium P, as the recording medium P is conveyed forward.

After passing through the secondary transfer station T2, the recording medium P is separated from the peripheral surface of the intermediary transfer drum 105, and then is introduced into a fixing apparatus 100 (image heating apparatus), in which the unfixed toner images are thermally fixed to the recording medium P. Thereafter, the recording medium P is discharged into an unillustrated delivery tray located outside the image forming apparatus. The fixing apparatus 100 will be described later in more detail.

After the transferring of the color toner images onto the recording medium P, the intermediary transfer drum 105 is cleaned by a cleaner 108; the residue, such as the toner particles, paper dust, and the like, left behind on the intermediary transfer drum 105 after the transfer, is removed by the cleaner 108. When not activated, the cleaner 108 is not kept in contact with the intermediary transfer drum 105; it is placed and kept in contact with the intermediary transfer drum 105 during the secondary transfer process in which the color toner images are transferred from the intermediary transfer drum 105 onto the recording medium P.

Also, the transfer roller 106 is not kept in contact with the intermediary transfer drum 105 when not activated; it is pressed against the intermediary transfer drum 105, with the recording medium P pinched between the transfer roller 106 and intermediary transfer drum 105, during the secondary transfer process in which the color toner images are transferred from the intermediary transfer drum 105 onto the recording medium P.

The image forming apparatus in this embodiment is enabled to operate also in a monochromatic printing mode; for example, it is capable of creating a black-and-white image. It is also enabled to operate in a double-sided printing mode, and a multilayer printing mode.

In a double-sided printing mode, after a set of toner images is formed on one of the two surfaces of the recording medium P, and the recording medium P is discharged from the fixing apparatus 100, the recording medium P is turned over through an unillustrated recirculating mechanism, and sent back into the secondary transfer station T2, in which another set of toner images is transferred onto the other side of the recording medium P. Thereafter, the recording medium P is again introduced into the fixing apparatus 100, in which the second set of toner images is fixed to the recording medium P. Then, the recording medium P, both sides of which bear a fixed image at this point, is outputted as a double-side print.

In a multilayer printing mode, after a set of toner images is formed on one of the two surfaces of the recording medium P, and the recording medium P is discharged from the fixing apparatus 100, the recording medium P is again sent into the secondary transfer station T2 without being turned over through the unillustrated recirculating mechanism. In the secondary transfer station T2, another set of toner images is transferred onto the very surface of the recording medium P, to which the first set of toner images has been already fixed. Thereafter, the recording medium P is introduced again into the fixing apparatus 100, in which the second set of toner images is fixed, and the recording medium P is outputted as a multilayer print.

Next, an image heating apparatus in accordance with the present invention will be described with reference to FIGS. 1–3. The image heating apparatus in accordance with the present invention is such an image heating apparatus (fixing device) that comprises a cylindrical fixing film (fixing belt) as a heating member, in which heat can be electromagnetically induced. It employs an electromagnetic heat induction system, and a pressure roller driving system.

(1) General Structure

Figure 1:
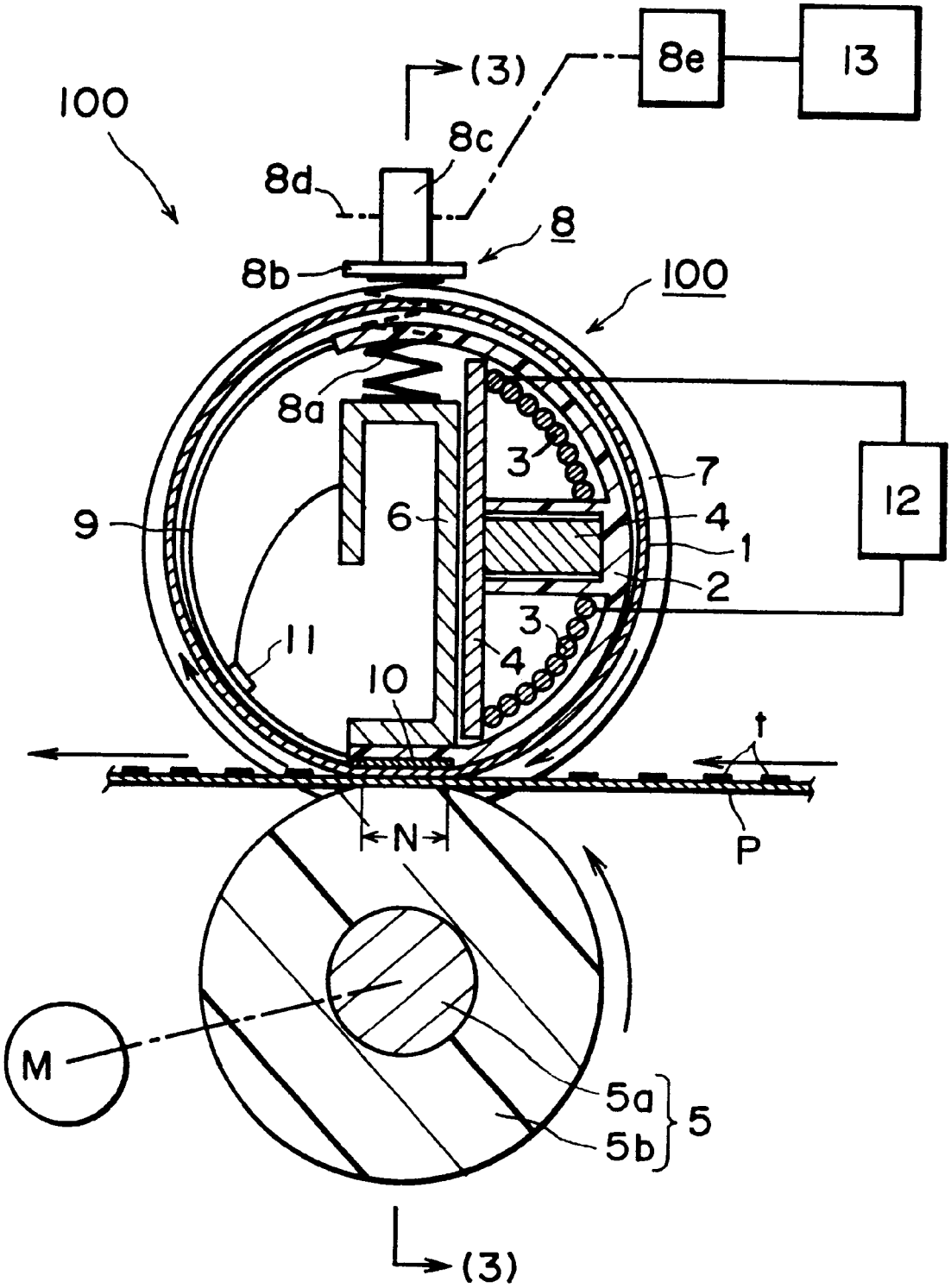
FIG. 1 is a sectional view of an image heating apparatus in an embodiment of the present invention, at a plane parallel to the side walls of the image heating apparatus.
Figure 2:
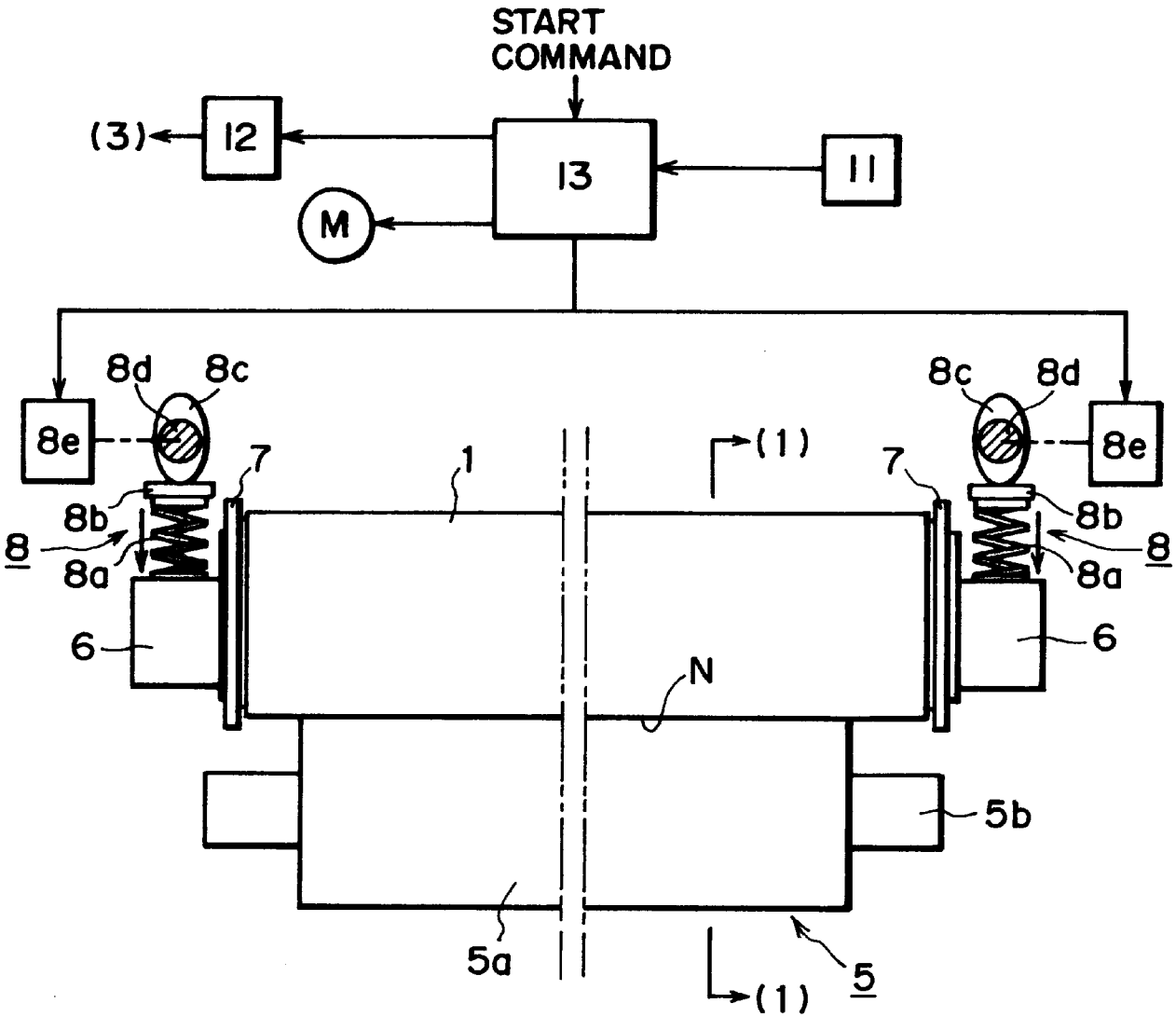
FIG. 2 is a front view of the image heating apparatus in FIG. 1.

FIG. 1 is a schematic sectional view of the essential portion of the thermal image fixing apparatus 100 as an image heating apparatus in accordance with the present invention, at a plane parallel to the side walls of the thermal image fixing apparatus 100 (at the line (1)—(1) in FIG. 2). FIG. 2 is a schematic front view of the essential portion of the apparatus in FIG. 1, with some portions of the apparatus unillustrated. FIG. 3 is a schematic, longitudinal sectional view of the apparatus in FIG. 1, with some portions of the apparatus unillustrated (at the line (3)—(3) in FIG. 1).

This apparatus 100 can be roughly divided into three members: first, second, and third members. The first member is a film guiding member 2, which is a trough-like member, and is approximately semicircular in cross-section. In FIG. 1, the film guiding member 2 looks like a cylindrical member, the left half of which is missing. The second member is a cylindrical fixing film 1, which is loosely fitted around the film guiding member 2, and a film guiding member 9 disposed in a manner to cover the left side of the film guiding member 2, and in which heat can be electromagnetically induced. The third member is a pressure roller 5, which is disposed below the film guiding member 2 so that it forms a nip N against the bottom surface of the film guiding member 2, with the fixing film pinched between the pressure roller 5 and the film guiding member 3.

On the inward side of the film guiding member 2, a combination of an exciter coil 3 and a magnetic core 4 is disposed as a magnetic field generating means.

The pressure roller 5 comprises a metallic core 5*a*, and an elastic layer 5*b* coated, in the form of a roller coaxial with the metallic core 5*a*, around the metallic core 5*a*. The material for the elastic layer 5*b* is elastic, heat resistant material such as silicone rubber, fluorinated rubber, fluorinated resin, or the like. It is rotationally supported between the side walls of the unillustrated chassis of the image apparatus; the longitudinal ends of the metallic core 5*a* are supported by bearings.

The film guiding member 2, around which the fixing film 1 is fitted, is disposed on the top side of the pressure roller 5. It is kept under the downward pressure generated by a pair of pressure applying mechanisms 8 and 8, which apply pressure to the correspondent longitudinal ends of a rigid stay 6 put through the space on the inward side of the film guiding member 2. With this arrangement, the bottom surface of the film guiding member 2, and the upwardly facing surface of the pressure roller 5, are pressed against each other, with the fixing film 1 pinched between the two surfaces, forming the fixing nip N.

The pressure roller 5 is rotationally driven by a motor, which constitutes a driving means M (FIG. 1), in the counterclockwise direction indicated by the arrow mark. As the pressure roller 5 is rotationally driven, the rotational force from the pressure roller 5 acts on the fixing film 1 due to the presence of the friction between the pressure roller 5 and the outwardly facing surface of the fixing film 1, in the fixing nip N. As a result, the fixing film 1 is rotated around the film guiding members 2 and 9 in the clockwise direction indicated by the arrow mark, at a peripheral velocity approximately equal to the peripheral velocity of the pressure roller 5, with the inwardly facing surface of the fixing film sliding on the bottom surface of the film guiding member 2 while remaining in contact therewith, within the fixing nip N (pressure roller driving system).

In order to improve the slidableness of the inwardly facing surface of the fixing film 1 against the bottom surface of the film guiding member 2 within the fixing nip N, in other words, in order to reduce the friction between the two surfaces within the fixing nip N, the bottom surface of the film guiding member 2 is provided with a slippery member 10, which is correspondent in position to the fixing nip N. As for the material for the slippery member 10, a plate of PI (polyimide), a plate of alumina coated with glass, or the like, is used, which is superior in heat resistance, and on which the fixing film 1 easily slides. In order to further improve the slidableness, lubricant such as grease is coated on the inwardly facing surface of the fixing film 1, in addition to the provision of the slippery member 10, so that the lubricant is provided between the slippery member 10 and the fixing film 1, within the fixing nip N.

Designated by referential codes 7 and 7 are flanges fitted one for one in the longitudinal ends of the film guiding member 2. The flanges control the deviation of the fixing film 1 in the longitudinal direction of the film guiding member 2; as the fixing film 1 deviates in the longitudinal direction of the film guiding member 2 from its normal position, it comes in contact with one of the flanges by its corresponding edge, being thereby prevented from further deviation. The flanges 7 and 7 may be structured so that they rotate following the rotation of the fixing film 1.

Thus, while the pressure roller 5 is rotationally driven, and the fixing film 1 rotates following the rotation of the pressure roller 5, heat is electromagnetically induced within the fixing film 1, as the heating member, by the magnetic field generated by the power supplied to the exciter coil 3 from an exciter circuit 12. As a result, the temperature of the fixing nip N is increased to, and kept at, a predetermined level. In this state, the recording medium P, on which a toner image t (unfixed) has been formed, is sent into the fixing nip N from the image forming means, between the fixing film 1 and pressure roller 5, with the recording medium P surface with the toner image facing upward, that is, facing the fixing film 1, and then is passed through the fixing nip N along with the fixing film 1, being pinched between the fixing film 1 and the pressure roller 5 so that the recording medium P surface with the toner image is kept tightly in contact with the outwardly facing surface of the fixing film 1. The portion of the fixing film 1, in which heat is actually generated by the function of the magnetic field generating means when the fixing film 1 is standing still, is the right-hand side of the fixing film 1, which is adjacent to the exciter coil 3 and magnetic core 4 (FIG. 1).

While the recording medium P is conveyed through the fixing nip N, being pinched therein, along with the fixing film 1, the unfixed toner image t on the recording medium P is fixed to the recording medium P by being heated by the heat electromagnetically induced in the fixing film 1.

After being passed through the fixing nip N, the recording medium P is separated from the peripheral surface of the rotating fixing film 1, and is conveyed further to be discharged. Also after being passed through the fixing nip N, the thermally fixed toner image t on the recording medium P cools down to become a permanently fixed image.

(2) Fixing Film 1

Figure 5:
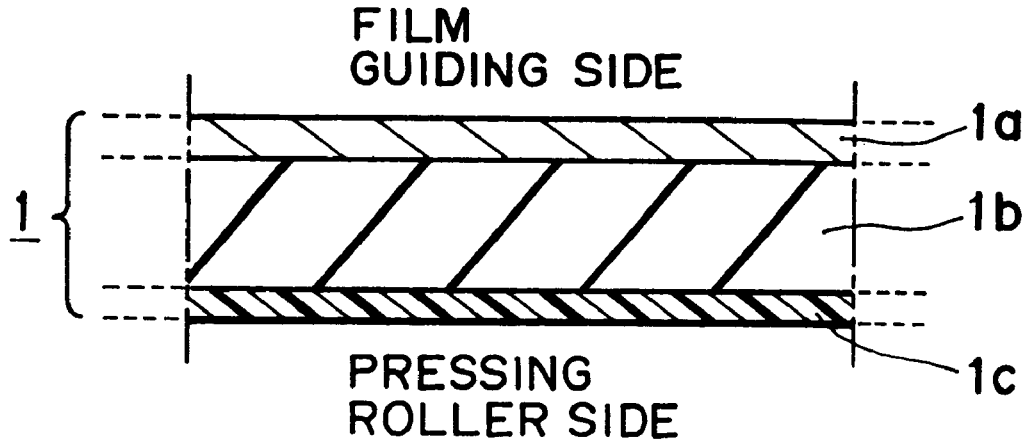
FIG. 5 is a schematic drawing which shows the laminar structure of the film.

FIG. 5 is a schematic drawing which shows the laminar structure of the fixing film 1. The fixing film 1 in this embodiment is a piece of laminar film, and comprises a heat generating layer 1*a*, an elastic layer 1*b* laminated on the outwardly facing surface of the heat generating layer 1*a*, and a mold releasing layer 1*c* laminated on the outwardly facing surface of the elastic layer 1*b*. The heat generating layer 1*a* is formed of metallic film or the like, and functions as the base layer of the fixing film 1 in which heat is electromagnetically induced. A primer layer may be provided between the heat generating layer 1*a* and elastic layer 1*b*, and between the elastic layer 1*b* and mold releasing layer 1*c*, to glue the three layers together.

In the approximately cylindrical fixing film 1, the heat generating layer 1*a* constitutes the inwardly facing layer, and the mold releasing layer 1*c* constitutes the outwardly facing layer. As described above, as an alternating magnetic flux acts on the heat generating layer 1*a*, eddy current is generated within the heat generating layer 1*a*. As a result, heat is generated within the heat generating layer 1*a*. Since the fixing film 1 is rotationally driven, heat is electromagnetically induced through the entirety of the fixing film 1, and the recording medium P passed through the fixing nip N is heated by the thus generated heat. Consequently, the toner image 5 is thermally fixed to the recording medium P.

As for the material for the heat generating layer 1*a*, ferromagnetic material such as nickel, iron, ferromagnetic SUS, nickel-cobalt alloy, or the like, is desirable. As for the thickness of the heat generating layer 1*a*, a range of 1–100 $\mu$m is desirable because of the relationship between the electromagnetic energy absorbency of the film and the rigidity of the film.

The elastic layer 1*b* is a layer necessary to cause the heating surface (surface of the mold releasing layer 1*c*) to conform to the unevenness of the recording medium P or toner layer so that the image is prevented from becoming uneven in glossiness. As for the material for the elastic layer 1*b*, material such as silicone rubber, fluorinated rubber, fluoro-silicone rubber, or the like, which is superior in heat resistance and thermal conductivity, is used. The elastic layer 1*b* is desired to be in a range of 10–500 $\mu$m in thickness, and to have a hardness of no more than 60 degrees (JIS-A: JIS-K, A-type tester).

The mold releasing layer 1*c* is in a range of 1–100 $\mu$m in thickness. As for the material for the mold releasing layer 1*c*, fluorinated resin (PFA, PTFE, FEP), silicone resin, fluoro-silicone rubber, fluorinated rubber, silicone rubber, or the like, which is superior in mold releasing property and heat resistance, is used.

Figure 6:
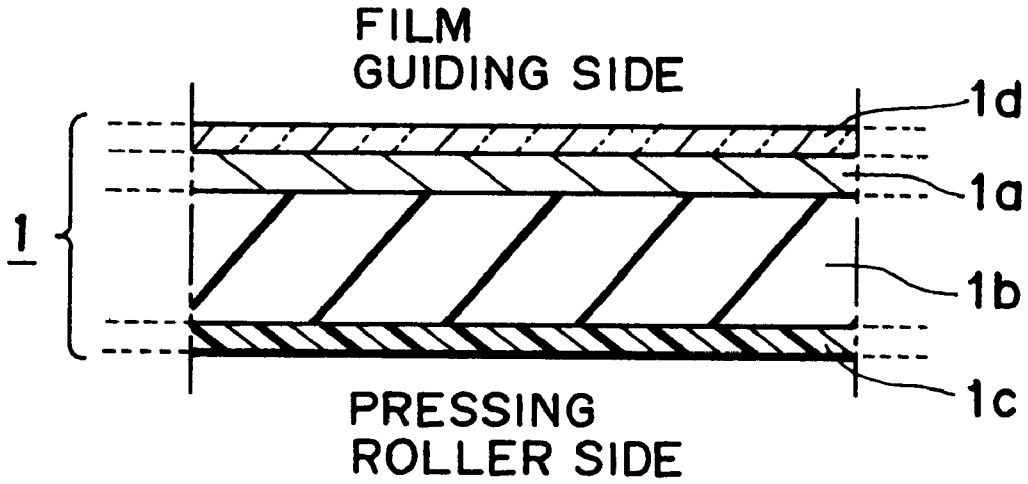
FIG. 6 is a schematic drawing which shows the laminar structure of the film.

In order to further improve the efficiency with which heat is supplied to the recording medium P, the free surface (the heat generating layer surface which faces opposite to the elastic layer 1*b*) of the heat generating layer 1*a* of the fixing film 1 may be covered with a heat insulating layer 1*d*, as shown in FIG. 6.

As for the material for the heat insulating layer 1*d*, heat resistant resin, for example, fluorinated resin (PFA, PTFE, FEP), polyimide, polyamide-imide, PEEK, PES, PPS, or the like, is desirable. The thickness of the heat insulating layer 1*d* is desired to be within a range of 10–1,000 μm.

With the provision of the heat insulating layer 1*d,* the heat generated in the heat generating layer 1*a* is prevented from conducting inward of the loop of the fixing film 1. Therefore, the efficiency with which the heat is supplied toward the recording medium P side is improved, compared to a fixing film without the heat insulating layer 1*d.* Consequently, power consumption is reduced.

(3) Film Guiding Member 2

The film guiding member 2 must assure that the exciter coil 3 is electrically insulated from the fixing film 1. Therefore, material such as phenol resin, polyimide, polyamide, polyamide-imide, PEEK, PES, PPS, PFA, PTFE, FEP, LCP, or the like, which is excellent in electrically insulating property and heat resistance, is used as the material for the film guiding member 2. The film guiding member 2 plays a role in pressing the fixing film 1 against the pressure roller 5 in the contact area (fixing nip N), supporting the combination of the exciter coil 3 and magnetic core 4 as the magnetic field generating means, supporting the fixing film 1, and assuring stability in the rotational conveyance of the fixing film 1. The film guiding member 9 is the same as the film guiding member 2 in terms of material. It also supports the fixing film 1, and assures stability in the rotational conveyance of the fixing film 1.

(4) Magnetic Field Generating Means 3 and 4

The exciter coil 3 is a coil constituted of a plurality of pieces of fine copper wire, which are individually coated for electrical insulation, are bound together, and are wound together a few times.

In this embodiment, polyimide is used as the heat resistant and electrically insulating coating material for the wires of the exciter coil 3. The number of times the exciter coil 3 is wound is eight (eight turns). The exciter coil 3 is formed (wound) so that it conforms to the inward surface of the film guiding member 2 to make it possible to generate heat in as large an area of the heat generating film as possible. The diameter of each piece of fine wire, and the cross sectional size of the bundle of the fine wires, and the like, are determined by the amount of the electrical current to be flowed through the exciter coil 3. In this embodiment, 98 pieces of bundled fine wires with a diameter of 0.2 mm (approximately 3.1 $mm^2$ in the cross sectional size of the bundle) are used.

To the exciter coil 3, the exciter circuit 12 is connected. This exciter circuit 12 is enabled to generate high frequency waves in a range of 20 kHz to 500 kHz with the use of a switching power source. The exciter coil 3 generates an alternating magnetic flux by being supplied with alternating current (high frequency current) which is supplied from the exciter circuit 12.

The magnetic core 4 is a core high in magnetic permeability. It is T-shaped in cross section. As for the material for the magnetic core 4, ferrite, Permalloy, or the like, which is used as the material for a transmission core, is desirable, preferably, ferrite which is small in loss even when the frequency is no less than 100 kHz.

The temperature of the fixing nip N is controlled by a temperature controlling system inclusive of a temperature detecting member 11 (apparatus temperature detecting means in FIG. 1). More specifically, the electrical current supply to the exciter coil 3 is controlled by the temperature controlling system so that the amount of the heat electromagnetically induced within the fixing film 1 is controlled. As a result, the temperature of the fixing nip N is maintained at a predetermined level. The temperature detecting member 11 is a temperature sensor, such as a thermistor, for detecting the temperature of the fixing film 1. In this embodiment, the temperature detecting member 11 is disposed within the loop of the fixing film 1, elastically in contact with the inwardly facing surface of the fixing film 1, on the downstream side of the fixing nip N in terms of the rotational direction of the fixing film 1. The information regarding the temperature of the fixing film 1 measured by the temperature sensor 11 is inputted as the apparatus temperature information into a control circuit 13. The current supply to the exciter coil 3 is controlled according to the thus inputted temperature information to control the amount of the heat electromagnetically induced in the fixing film 1so that the temperature of the fixing nip N is kept at the predetermined level.

(5) Pressure Applying Mechanism 8 and Pressure Control

As described above, both longitudinal ends of the rigid pressure application stay 6 put through the space on the inward side of the film guiding member 2 are pressed downward by the pressure generated by the pressure applying mechanisms 8 and 8, so that the bottom surface of the film guiding member 2 is pressed against the upwardly facing surface of the pressure roller 5, with the fixing film 1 pinched between the two surfaces, to form the fixing nip N.

The pressure applying mechanisms 8 and 8 disposed one for one at both longitudinal ends of the rigid pressure application stay 6 are enabled to vary the amount of the pressure they apply. Each pressure applying mechanism 8 comprises a pressure generating spring 8*a,* a spring seating member 8*b,* an oval cam 8*c* (pressure adjusting member), a cam shaft 8*d,* a driving mechanism 8*e,* and the like. The pressure generating spring 8*a* is disposed so that its bottom end is seated against the upwardly facing surface of the corresponding longitudinal end of the rigid pressure application stay 6, and the top end of the pressure generating spring 8*a* is seated against the spring seating member 8*b* disposed above the pressure generating spring 8*a.* The oval cam 8*c* is placed in contact with the spring seating member 8*b.* The cam shaft 8*d* is rotated by the driving mechanism 8*e* to rotate the cam 8*c.*

The pressure generating spring 8*a* is disposed in the compressed state between the upwardly facing surface of the corresponding longitudinal end of the rigid pressure generation stay 6 and the cam 8*c.* The reactive force from the compression of the pressure generating spring 8*a* acts as the pressure which applies to the recording medium P within the fixing nip N.

The driving mechanism 8*e* comprises a clutch solenoid, or the like. It is controlled by the control circuit 13 to intermittently rotate the cam shaft 8*d* by 90 degrees to intermittently rotate the cam 8*c* by 90 degrees. The left and right pressure generating mechanisms 8 and 8 are intermittently rotated by 90 degrees in synchronous phase.

Figure 3:
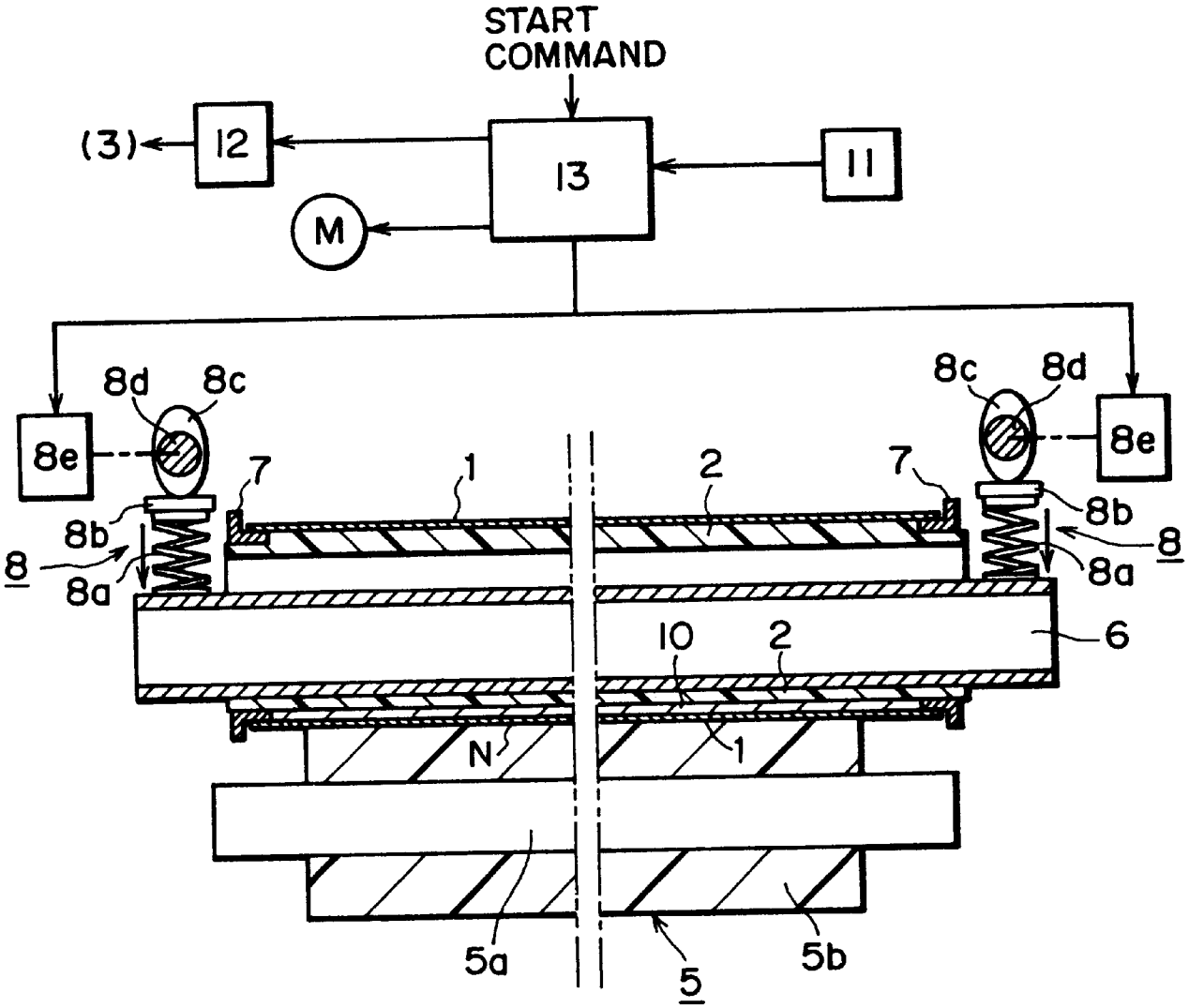
FIG. 3 is a sectional view of the image heating apparatus in FIG. 1, at a plane parallel to the front wall of the image heating apparatus.
Figure 4:
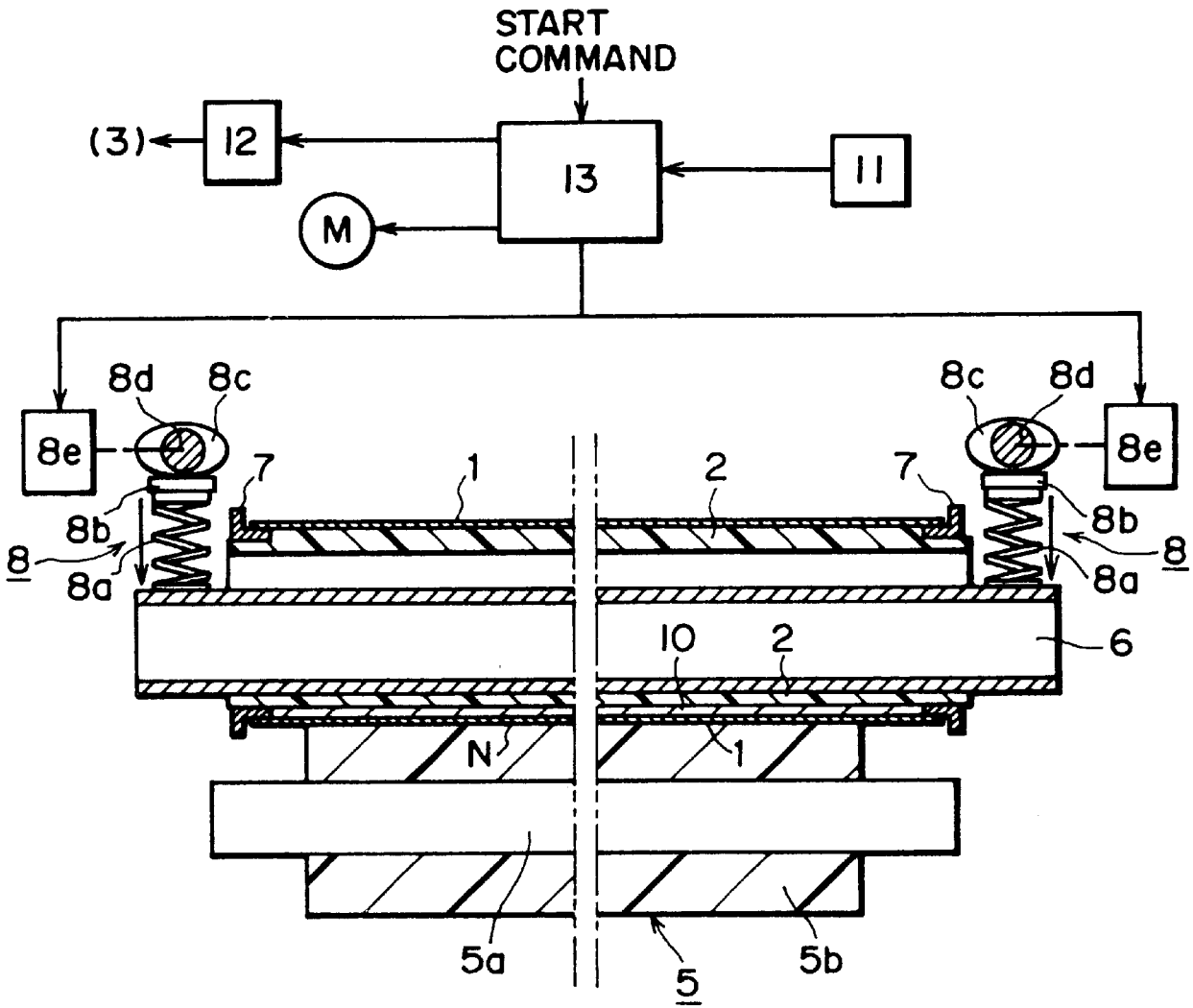
FIG. 4 is a sectional view of the image heating apparatus in FIG. 1, at a plane parallel to the front wall of the image heating apparatus.

As the oval cam 8*c* is intermittently rotated by 90 degrees so that the major axis of the oval cam 8*c* becomes vertical as shown in FIGS. 1–3, in other words, so that the oval cam 8*c* is positioned to cause the high lift portion of the cam 8*c* to be in contact with the spring seating member 8*b,* the amount by which the pressure generating spring 8*d* is compressed increases, creating pressure application state B, in which pressure is applied to the recording medium P by the amount (for example, 30 kgf) necessary for the proper thermal fixation of a toner image in the fixing nip N.

When the oval cam 8*c* is laid sideways, in other words, when the oval cam 8*c* is positioned so that the low lift portion of the over cam 8*c* is caused to be in contact with the spring seating member 8*b,* the amount by which the pressure generating spring 8*a* is compressed is relatively small, creating pressure application state A, in which the pressure which applies to the recording medium P within the fixing nip N is smaller (for example, 10 kgf) than that in the above described pressure application state B. The pressure applied in the pressure application state A is greater than zero.

In other words, the image fixing apparatus 100 in this embodiment is enabled to apply two different levels of pressures to the recording medium P. Further, in order to assure that a toner image is properly fixed to special purpose recording medium, such as high gloss paper or thick paper, the image fixing apparatus 100 in this embodiment is set up so that the pressure applied in the pressure application state B by this fixing apparatus 100 is greater, compared to the pressure applied by a conventional fixing apparatus.

Figure 7:
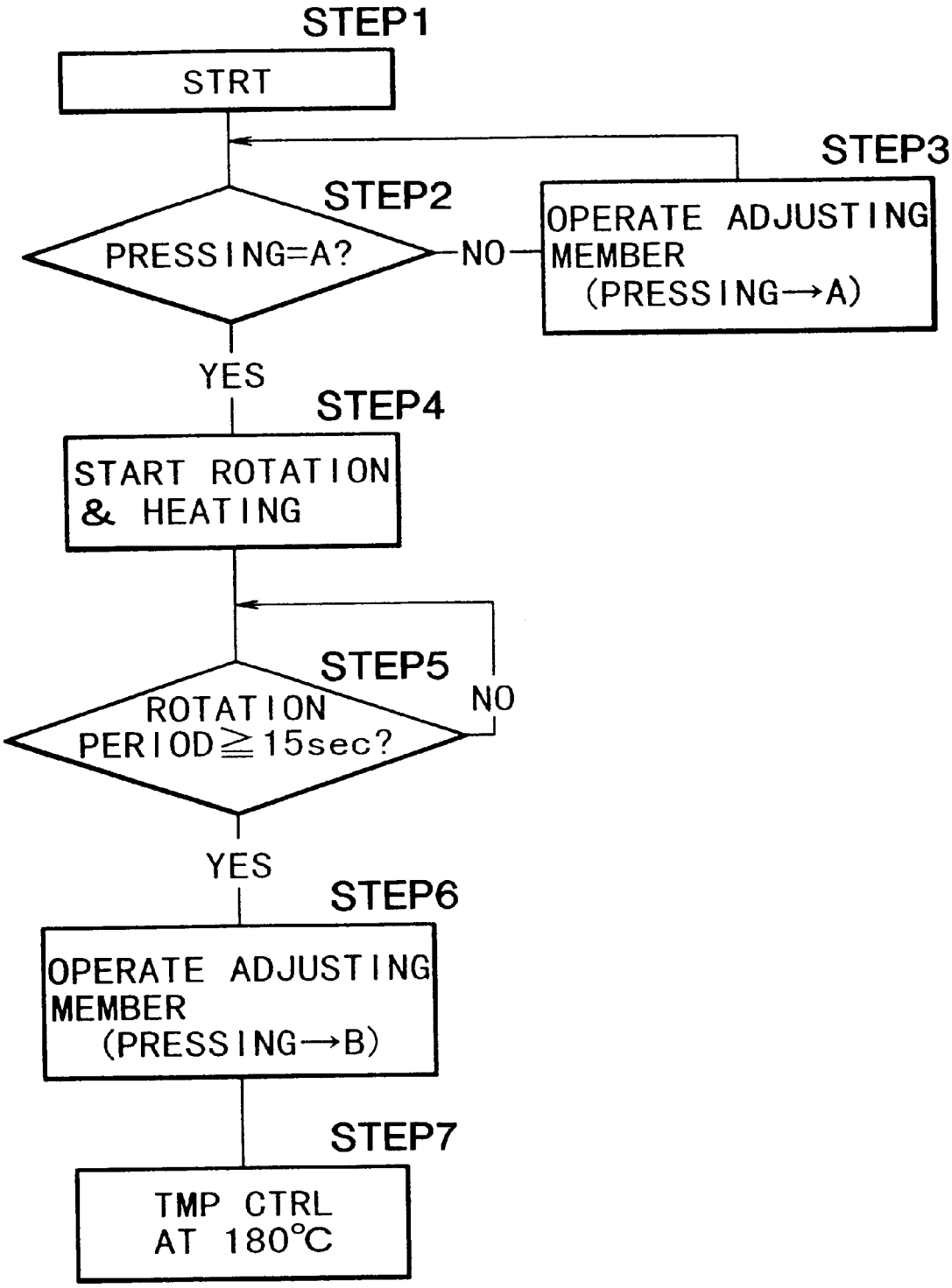
FIG. 7 is a flow chart which shows the control of the image heating apparatus.

Next, this fixing apparatus will be described regarding the driving control. FIG. 7 is a flow chart which shows a method for controlling the fixing apparatus in this embodiment.

Upon receiving a fixing operation initiation instruction, that is, an instruction for initiating an image heating operation (Step 1), the control circuit 13 confirms the state of pressure application (Step 2). When the apparatus is not in the pressure application state A, the control circuit 13 controls the pressure applying mechanisms 8 and 8 so that the fixing nip N is placed in the pressure application state A, that is, the low pressure application state, by the pressure adjusting members (cams) 8*c* and 8*c* (Step 3). While a power source is off, or the apparatus is on standby, the fixing nip N is placed in the pressure application state A, that is, the low pressure state, by the pressure adjusting members 8*c* and 8*c* to prevent deformation or the like.

Next, the control circuit 13 rotationally drives the pressure roller 5 by the driving means M while keeping the fixing nip N in the pressure application state A, and flows rated current through the exciter coil 3 from the exciter circuit 12 to begin electromagnetically inducing heat in the fixing film 1 (Step 4).

As the pressure roller 5 is rotationally driven, the rotational force from the pressure roller 5 acts on the fixing film 1 due to the presence of the friction between the pressure roller 5 and the outwardly facing surface of the fixing film 1, in the fixing nip N. As a result, the fixing film 1 is rotated around the film guiding members 2 and 9, while being heated, with its inwardly facing surface sliding on the slippery member 10 and film guiding member 2, tightly in contact therewith, at a peripheral velocity approximately equal to the rotational speed of the pressure roller 5.

The fixing film 1 is rotated and heated for a predetermined length of time (for example, 15 seconds), with the fixing nip N kept in the pressure application state A, and then, the pressure application state is changed from the state A to the state B by the operation of the pressure adjusting member (Step 5 6). Thereafter, the fixing apparatus is controlled so that the temperature within the fixing nip N remains at a predetermined level (for example, 180° C.) suitable for image fixation; the fixing apparatus is controlled so that the fixing apparatus remains in the state in which image fixation is possible (Step 7).

Naturally, when the temperature in the fixing nip N is low, the friction between the fixing film 1 and pressure roller 5 is relatively high. In particularly, when grease is present between the filing film 1 and pressure roller 5, the friction between the fixing film 1 and guiding member 2 is relatively high because the viscosity of the grease is higher when temperature is lower. However, with the provision of the above described arrangement for apparatus control, when a fixing apparatus is started up, it is possible to reduce the torque required when starting up the fixing apparatus, in order to assure that fixing film properly slides. Therefore, even when a fixing apparatus is started up in a low temperature environment in which higher torque is required to start up a fixing apparatus, it is assured that the fixing film 1 smoothly slides; the pressure roller 5 is prevented from being rotated. In other words, with the provision of the above described arrangement for apparatus control, the amounts of the pressure, as well as the sizes of the contact areas, between the fixing film 1 and slippery member 10, and between the fixing film 1 and the outwardly facing surface of the film guiding member 2, can be reduced by reducing the amount of the pressure applied by the pressure applying members, in other words, by placing a fixing nip N in the pressure application state A (Steps 2 and 3), so that the frictional resistance at the aforementioned contact areas is reduced to reduce the torque required at the time of starting up a fixing apparatus. Therefore, the slidableness of the fixing film 1 is assured to prevent the fixing film 1 from failing to move.

Further, the fixing film 1 is rotated and heated, while the fixing nip N is kept in the state A (Step 4), for a predetermined length of time to increase the temperature of the fixing film 1. As the temperature of the fixing film 1 increases, the temperature of the slippery member 10 and grease also increases, making it easier for the fixing film 1 to slide. Therefor, the torque required for rotational driving the fixing film 1 further reduces.

After the elapsing of the predetermined length of time necessary to assure that the fixing film 1 smoothly slides, the fixing nip N is placed in the pressure application state B (Step 5 6), to increase the amount of the pressure applied by the pressure applying members so that a proper amount of pressure is generated in the fixing nip N.

Thus, when a fixing apparatus which requires high fixing pressure is started up in a low temperature environment, it is possible to reduce the amount of the initial torque necessary for the startup. Therefore, it is possible to prevent the occurrences of inconveniences. For example, it is possible to prevent the fixing film 1 from failing to slide, to prevent warm-up time from becoming excessively long, or to prevent the fixing film 1 from being damaged. In addition, with the provision of the above described arrangement for apparatus control, high fixing pressure necessary when forming an image on special purpose recording medium, such as high gloss paper or thick paper, can be easily obtained, and therefore, it is possible to prevent the problem that a toner image fails to be properly fixed. Further, it is possible to prevent the motor from breaking down due to an excessive amount of external load.

Table 1 shows the amount of the initial torque measured when the fixing apparatus in this embodiment is started up in a low temperature environment, and the results of the evaluation of the images fixed to thick paper.

Table 1 also presents the results of two cases in which the fixing pressure was not adjusted by the pressure application members 8*c* and 8*c*, that is, in which the fixing apparatus was kept in the high pressure state (Comparative Example 1: equivalent to pressure application state B) and low pressure state (Comparative Example 2: equivalent to pressure application state A).

TABLE 1

| | Initial Torque (kgf.cm) | Film Rotation | Evaluation of Fixed Image |
|---|---|---|---|
| This Embodiment | R | OK | OK |
| Comp. Example 1 | 15–25 | NG (stopped) | — |
| Comp. Example 2 | 8 | OK | NG (fixation failure) |

As is evident from Table 1, in the case of Comparative Example 1, the required initial torque was in a range of 15–25 kgf·cm, which was rather high, causing the fixing film 1 to remain standing still for a while when the fixing apparatus was started up in a low temperature environment. As a result, the problems occurred; for example, it took a long time for the fixing apparatus to warm up, and/or damages occurred to the fixing film 1.

In the case of Comparative Example 2, the required initial torque was 8 kgf·cm, which did not prevent the fixing film from moving. However, the amount of the fixing pressure was not sufficient, and therefore, fixed images were not good; they suffered from fixation failure.

On the contrary, in the case of the fixing apparatus in this embodiment, the required initial torque was 8 kgf·cm, and the fixing film 1 did not fail to move. As a result, images were satisfactorily fixed.

In other words, according to the present invention, even in the case of a fixing apparatus which requires a higher amount of fixing pressure, its fixing film can be prevented from failing to move, by adjusting the pressure applied to the fixing nip when the fixing apparatus is started up in a low temperature environment, as in the case of the fixing apparatus in this embodiment. Therefore, it is possible to prevent such problems that warm-up time is long, and/or that the fixing film is damaged.

When the fixing apparatus in this embodiment is started up in a low temperature environment, it reaches 150° C. or higher, which is high enough to assure that the fixing film smoothly slides by being assisted by the grease, slippery member 10, and the like, in 15 seconds after power begins to be supplied thereto. The length of 15 seconds, which is set for the fixing apparatus in this embodiment, is determined based on the length of time necessary for the fixing apparatus to reach a specific temperature level (150° C. in this embodiment) which assures that the fixing film smoothly slides. These values (temperature, time) vary depending upon the configuration of an individual fixing apparatus (torque, total thermal capacity, fixing pressure), amount of supplied power, and the like, and therefore, they are optionally set according to these factors.

Figure 8:
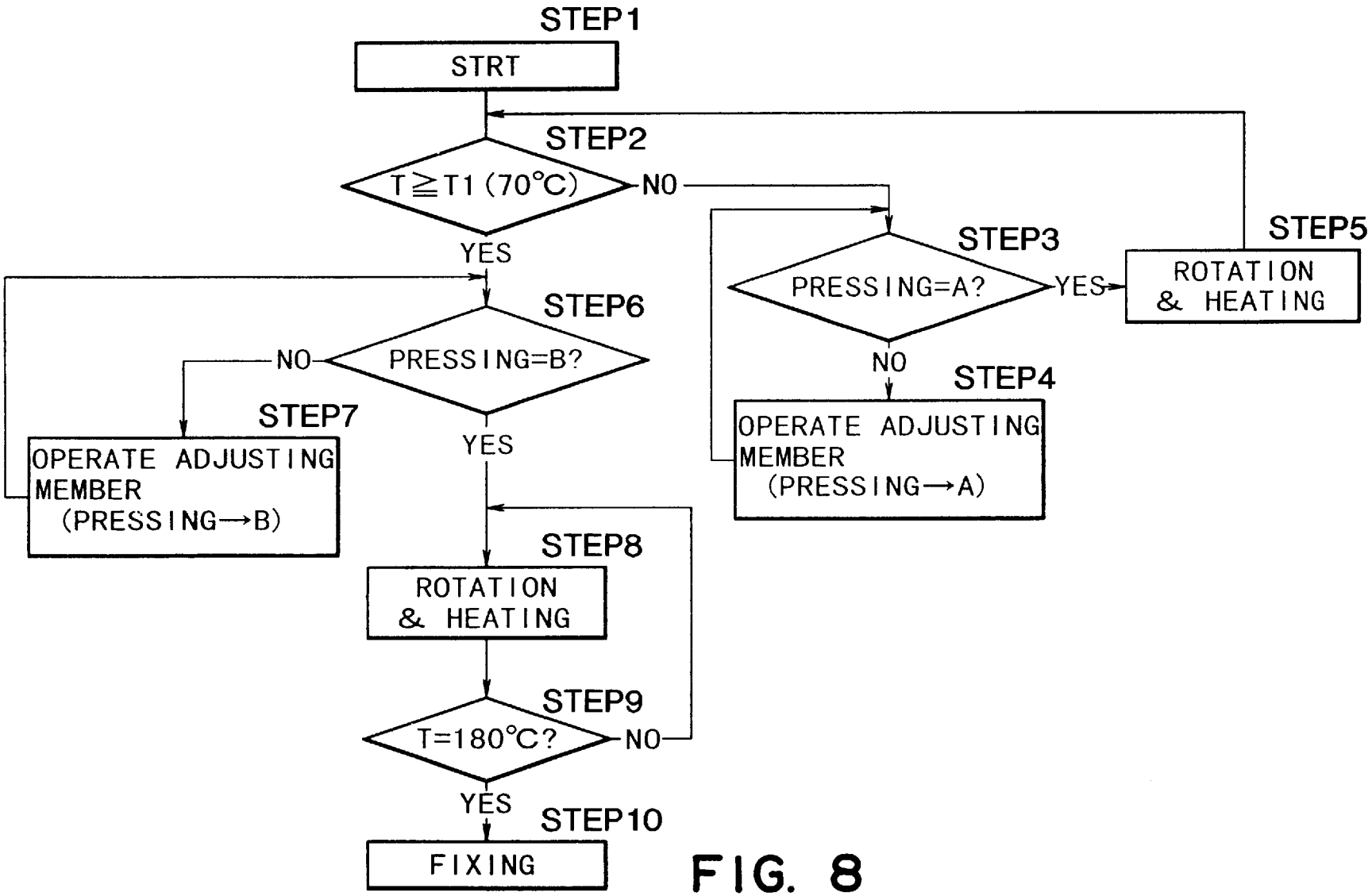
FIG. 8 is a flow chart which shows the control of the image heating apparatus.

FIG. 8 is a flow chart which shows the method for controlling a fixing apparatus, in another embodiment of the present invention. In this embodiment, the fixing apparatus is controlled so that the pressure applied by the pressure application members is switched according to the temperature detected by the temperature detecting member 11.

More specifically, upon reception of an instruction for initiating a fixing operation (Step 1), the control circuit 13 determines, based on the temperature detected and inputted by the temperature detecting member 11, whether or not the temperature T detected at the beginning of the fixing operation is no more than a predetermined temperature T1 (for example, 70° C.) (Step 2).

When the detected temperature T is no more than the referential temperature T1, the rotating and heating of the fixing film are started, with the fixing nip N placed in the pressure application state A (when the fixing nip N is in the pressure application state B, the pressure application state of the fixing nip N is switched to the state A, whereas the fixing nip N is in the pressure application state A, it is left in the same state), and the rotating and heating of the fixing film are continued until the detected temperature T reaches the referential temperature T1 (Steps 3, 4, and 5).

As the detected temperature T reaches the referential temperature T1, the pressure application state of the fixing nip N is switched from the state A to the state B by activating the pressure adjusting members 8*c* and 8*c* (Step 6), and the temperature is controlled so that it reaches a proper fixation temperature (180° C.) (Steps 8 and 9). Then, after the proper fixation temperature is reached, that is, after satisfactory fixation becomes possible, an actual fixing operation is started (Steps 9 and 10).

On the other hand, when the temperature T detected at the beginning of a fixing operation is no less than the predetermined referential temperature T1 (response in Step 2 is YES), the rotating and heating of the fixing film are started, with the fixing nip N placed in the pressure application state B (when the fixing nip N is in the pressure application state A, the pressure application state of the fixing nip N is switched to the state B, whereas the fixing nip N is in the pressure application state B, it is left in the same state) (Steps 6, 7, and 8), and the temperature is controlled so that it reaches the proper fixation temperature (180° C.) (Steps 8 and 9). Then, after the proper fixation temperature is reached, that is, after satisfactory fixation becomes possible, an actual fixing operation is started (Steps 9 and 10).

Configuring and controlling a fixing apparatus as described above makes it possible to reduce the initial torque required when starting up the fixing apparatus, to assure that the fixing film smoothly slides. Therefore, even when the fixing apparatus is started up in a low temperature environment, it is possible to prevent the fixing film from failing to move.

Further, when the apparatus temperature T detected at the beginning of the driving of the apparatus is no less than the predetermined referential temperature T1, it is unnecessary for the pressure application state of the fixing nip N to be switched to the low pressure application state A. In other words, the step for switching the pressure application state can be eliminated, and therefore, the apparatus can be readied faster for an actual fixing operation.

In the case of the above described embodiment, the fixing apparatus was configured so that the pressure adjustment, rotational driving of the fixing film, and heating of the fixing film, were started after the confirmation of the pressure application state, temperature detection, and the like, which were carried out upon reception of the instruction for initiating a fixing operation. However, a fixing apparatus may be configured so that the pressure adjustment is made at the beginning of the rotational driving of a fixing apparatus, according to the structure (film, slippery member, pressure roller, and the like), cumulative usage time, and/or the like, of the fixing apparatus.

In other words, a fixing apparatus may be structured so that the referential fixing film temperature, according to which the pressure applied by the pressure applying members is adjusted, can be varied depending on the ambient temperature and/or cumulative usage time, for example.

Further, in this embodiment, the referential temperature T1 is set at a temperature (70° C.), which is lower than the fixation temperature (180° C.). However, the referential temperature T1 may be rendered the same as the fixation temperature as indicated by the control flow chart in FIG. 9.

Also, a fixing apparatus may be structured so that the pressure application state of the fixing nip N is switched to the pressure application state A during the post-rotation period which occurs at the end of an fixing operation. With such an arrangement, it is possible to eliminate the time otherwise necessary for the pressure adjusting mechanism operation, at the beginning of a fixing operation. The post-rotation period means the period immediately after the last recording medium has been put through the fixing apparatus 100 in a continuous printing mode (when in a single copy mode, it is the period immediately after the single copy has been passed through the fixing apparatus 100). In this post-rotation period, the driving of the main motor is continued for a while after the passing of the last recording medium through the fixing apparatus 100, to cause the apparatus to carry out predetermined post-image formation procedures. After this post-rotation period, the driving of the main motor is stopped, and the apparatus is placed on standby to be kept on standby until an instruction for initiating the next operation is inputted.

Further, the pressure applied during the pressure application state A may be further reduced to 4 kgf, for example, so that paper jam or the like can be dealt with while the fixing nip N is in the pressure application state A.

Further, from the viewpoint of reducing the amount of the load which applies to the motor, it is effective to make the rotational speed of the driver roller slower during the starting up than during the fixing operation, so that the amount of the initial torque required when starting up the fixing film is further reduced.

Next, another embodiment of the present invention will be described. In this embodiment, the film heating type fixing apparatus employs a ceramic heater as a heating member.

Figure 10:
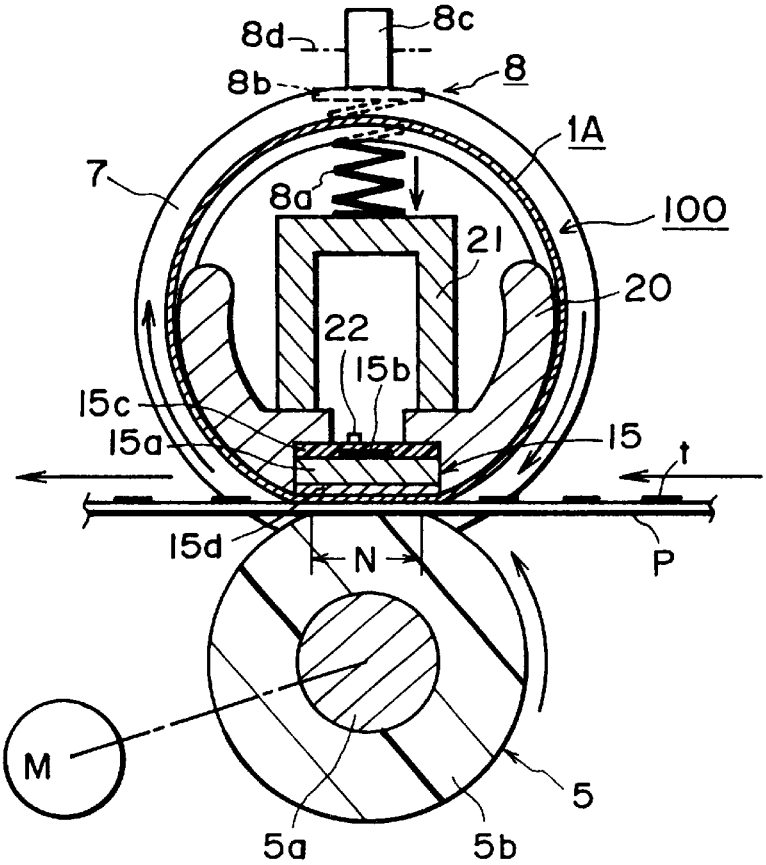
FIG. 10 is a sectional view of the image heating apparatus in another embodiment of the present invention, at a plane parallel to the front wall of the image heating apparatus.

The fixing apparatus 100 in this embodiment, which is shown in FIG. 10, can be roughly divided into a film guiding member 20, a ceramic heater 15 as a heating member, a fixing film 1A, and a pressure roller 5 as a pressuring member. The film guiding member 20 is a trough-like member, and is approximately semicircular in cross-section. It is heat resistant and heat insulating. It is provided with a groove, which longitudinally extends along the approximate center line of the bottom surface of the film guiding member 20. The ceramic heater 15 is fixedly fitted in the groove of the film guiding member 20. The fixing film 1A is a cylindrical (endless) piece of heat resistant film, and is loosely fitted around the film guiding member 20 inclusive of the ceramic heater 15. The film guiding member 20 inclusive of the ceramic heater 15 is pressed upon the pressure roller 5, forming a nip N, with the fixing film 1A pinched between the downwardly facing surface of the ceramic heater 15 and the pressure roller 5. In this embodiment, the ceramic heater 15, or the film guiding member 20 inclusive of the ceramic heater 15, constitutes the aforementioned first member, and the fixing film 1A constitutes the second member. The pressure roller 5 is the third member.

The pressure roller 5 is an elastic pressure roller. It comprises a metallic core 5*a,* and an elastic layer 5*b* placed on the peripheral surface of the metallic core 5*a* to reduce the hardness of the pressure roller 5. The material for the elastic roller 5*a* is silicone rubber or the like. The pressure roller 5 is rotationally supported between the unillustrated front and rear plates of the apparatus chassis; its longitudinal ends are supported by bearings. The peripheral surface of the elastic layer 5*b* may be coated with fluorinated resin such as PTFE, PFA, or FEP to improve the surface properties of the pressure roller 5.

The film guiding member 20, around which the fixing film 1A is fitted, is disposed above the pressure roller 5, with the ceramic heater 15 side facing downward. Through the space on the inward side of the film guiding member 20, a rigid pressure application stay 21 is put through, and a pair of pressure applying mechanisms 8 are positioned between the longitudinal ends of the pressure application stay 21 and a pair of spring seating members provided on the apparatus chassis side, one for one, so that the pressure application stay 21 is kept under downward pressure. With this arrangement, the downwardly facing surface of the ceramic heater 15 on the film guiding member 20 side is pressed against the upwardly facing surface portion of the pressure roller 5, with the fixing film 1A between the two surfaces, forming the fixing nip N.

The pressure roller 5 is rotationally driven by a driving means M, in the counterclockwise direction indicated by an arrow mark. As the pressure roller 5 is rotationally driven, the rotational force from the pressure roller 5 acts on the fixing film 1A due to the presence of the friction between the pressure roller 5 and the outwardly facing surface of the filing film 1A. As a result, the fixing film 1A is rotated around the film guiding members 20 in the clockwise direction indicated by an arrow mark, at a peripheral velocity approximately equal to the peripheral velocity of the pressure roller 5, with the inwardly facing surface of the fixing film 1A sliding on the downwardly facing surface of the ceramic heater 15 while remaining tightly in contact therewith within the fixing nip N (pressure roller driving system).

In order to reduce the friction which occurs between the bottom surface of the ceramic heater 15, that is, the surface on which the fixing film 1A slides in the fixing nip N, and the inwardly facing surface of the fixing film 1A, the bottom surface of the ceramic heater 15 is provided with a slippery member 15*d,* which is similar to the slippery member 10 of the fixing apparatus in the preceding embodiment. Further, lubricant such as heat resistant grease is provided between the slippery member 15*d* and the inwardly facing surface of the fixing film 1A.

In response to a print start signal, the rotation of the pressure roller 5 is started, along with the heating up of the ceramic heater 15. After the rotational speed of the fixing film 1A rotated by the rotation of the pressure roller 5 becomes constant, and the temperature of the ceramic heater 15 reaches a predetermined level, a piece of recording medium P, as an object to be heated, on which a toner image t is borne, is introduced between the fixing film 1A and pressure roller 5, with the toner bearing surface of the recording medium P faced toward the fixing film 1A, in the fixing nip N. Then, the recording medium P is passed, along with the fixing film 1A, through the fixing nip N, while being pressed upon the bottom surface of the ceramic heater 15. While the recording medium P is passed through the fixing nip N, the heat from the ceramic heater 15 is given to the recording medium P through the fixing film 1A. As a result, the toner image t is thermally fixed to the surface of the recording medium P. After passing through the fixing nip N, the recording medium P is separated from the surface of the fixing film 1A to be further conveyed.

In order to reduce the thermal capacity of the fixing film 1A so that the fixing apparatus starts up quickly, the thickness of the fixing film 1A is desired to be no more than 100 $\mu$m, preferably, no more than 50 $\mu$m and no less than 20 $\mu$m. The material for the fixing film 1A may be heat resistant PTFE, PFA, or FEP, which may be used in a single layer, or in the form of compound, laminar film. In the case of the latter, PTFE, PFA, FEP, or the like, is coated on the outwardly facing surface of a base layer of PEEK, PES, PPS, or the like. In this embodiment, the fixing film 1A comprises a cylindrical base film formed of polyimide, and a layer of PTFE coated on the outwardly facing surface of the base film. It is 25 mm in diameter.

The ceramic heater 15 as a heating member is a linear heating member with low thermal capacity. It is disposed perpendicular to the moving direction of the fixing film 1A and recording medium P. In this embodiment, the ceramic heater 15 basically comprises a substrate 15*a,* a heat generating layer 15*b,* and a protective layer 15*c*. The substrate 15*a* is formed of aluminum nitride (AIN) or the like. The heat generating layer 15*b* is extended on the surface of the substrate 15*a* in the longitudinal direction of the substrate 15*a;* more specifically, electrically resistive material such as Ag/Pd (silver/palladium) is coated, approximately 10 $\mu$m thick and approximately 1–5 mm wide, by screen printing, or the like. The protective layer 15*c* is formed of glass, fluorinated resin, or the like, and is placed on the heat generating layer 15*b*. The slippery member 15*d* is placed on the back surface on the substrate 15*a,* that is, the surface opposite to the front side where the heat generating layer 15*b* and protective layer 15*c* are located.

An electrical current is flowed between the longitudinal ends of the heat generating layer 15*b* of the ceramic heater 15, the heat generating layer 15*b* generates heat, quickly raising the temperature of the heater 15. The temperature of the heater 15 is detected by a temperature sensor 22, and is used by a control circuit to control the amount of power supplied to the heat generating layer 15*b,* so that the heater temperature is kept at a predetermined level.

The ceramic heater 15 is fixedly fitted in the groove extended along the approximate longitudinal center line, in the bottom surface of the film guiding member 20, with the protective layer 15*c* side facing upward.

The structure of the pressure applying mechanism 8, and control for switching between the pressure application states A and B, are the same as those in the preceding embodiment. The same effects as those provided by the fixing apparatus in the preceding embodiment can be also provided by the fixing apparatus in this embodiment, which is different in heating means from the fixing apparatus in the preceding embodiment.

As long as the material for the substrate 15*a* itself of the ceramic heater 15 is excellent in terms of its slidableness against the fixing film 1A, it is unnecessary to provide the substrate 15*a* with the slippery member 15*d;* the surface of the substrate 15*a* itself may be used as the surface on which the fixing film 1A slides.

The ceramic heater 15 as a heating member of the fixing apparatus in this embodiment may be replaced with a plate of such material as iron, in which heat can be electromagnetically induced. In such a case, the fixing apparatus is provided with a combination of an exciter coil and a magnetic core, as a magnetic field generating means, and heat is electromagnetically induced in, for example, an iron plate, to be given to the recording medium P through the fixing film 1A, in the fixing nip N.

Next, another embodiment of the present invention will be described.

The structure of a fixing apparatus as a heating apparatus does not need to be limited to such a structure as the structure of the fixing apparatus 100 in the preceding embodiments, which employed a pressure roller driving system.

Figure 11:
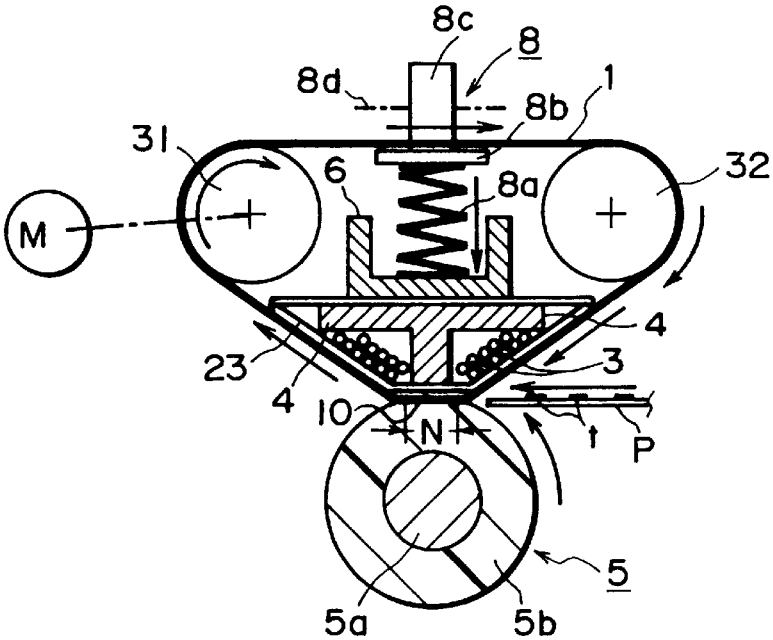
FIG. 11 is a sectional view of the image heating apparatus in another embodiment of the present invention.

For example, referring to FIG. 11, a fixing film 1, that is, an endless piece of film in which heat can be electromagnetically induced, may be stretched around a film guiding member 23, a driver roller 31, and a tension roller 32. In this case, a fixing nip N is formed between the bottom surface of the film guiding member 23 and a pressure roller as a pressuring member, by the pressure from a pressure applying mechanism 8, with the fixing film 1 pinched between the bottom surface of the film guiding member 23 and the pressure roller 5. In this case, fixing film 1 is rotationally driven by the driver roller 31, and the pressure roller 5 functions as a follower roller.

On the inward side of the film guiding member 23, a combination of an exciter coil 3 and a magnetic core 4 is provided as a magnetic field generating means.

The portion of the bottom surface of the film guiding member 23, which corresponds to the fixing nip N, is provided with a slippery member 10 to reduce the friction between the inwardly facing surface of the fixing film 1 and the bottom surface of the film guiding member 23. Further, lubricant such as heat resistant grease is provided between the slippery member 10 and the inwardly facing surface of the fixing film 1, in the fixing nip N.

The structure of the pressure applying mechanism 8, and control for switching between the pressure application states A and B, are the same as those in the preceding embodiments. The same effects as those provided by the fixing apparatuses in the preceding embodiments can be also provided by the fixing apparatus in this embodiment, which is different in heating means from the fixing apparatuses in the preceding embodiments.

As described above, according to the present invention, a fixing apparatus is structured so that while the fixing apparatus is started up, the pressure application state in the fixing nip N is kept in, or switched to, the pressure application state A, in which the pressure in the fixing nip N is smaller than the pressure in the fixing nip N in the pressure application state B, so that the torque required to start up the fixing apparatus is reduced. Therefore, even in the case of a fixing apparatus in which the pressure applied to an object to be charged, while heating the object, is set relatively high, it is assured that the aforementioned first and second members smoothly slide against each other, even in a low temperature environment, so that the second member is prevented from failing to move. Thus, it is possible to prevent the occurrence of the inconveniences associated with a conventional, film heating type fixing apparatus. For example, it is possible to reduce the warm-up time, and/or to prevent the fixing film as the second member from being damaged.

Further, according to the present invention, initially, the pressure application state of the fixing nip N is kept in, or switched to, the state A. Then, after the elapsing of a predetermined length of time, that is, after the apparatus temperature climbs to a predetermined level, the pressure application state of the fixing nip N is switched to the state B, in which a predetermined higher amount of pressure is applied in the fixing nip N while heating an object to be heated. Therefore, it is assured that the object to be heated is properly pinched in, and carried through, the fixing nip N, to be properly heated. In other words, a thermal, image fixing apparatus in accordance with the present invention assures that a recording medium is properly conveyed to produce a high quality image.

It is obvious that the structure of the pressure applying mechanism 8 does not need to be limited to the structure in this embodiment. For example, a fixing apparatus may be structured so that the pressure application state can be adjusted in three or more steps, or even steplessly.

Further, when the fixing film 1 in which heat is electromagnetically induced is used for thermally fixing only a monochromatic image or a single-pass multicolor image, the elastic layer 1*b* may be eliminated. The material for the heat generating layer 1*a* may be a mixture of resinous material and metallic filler. The fixing film 1 may be formed of a heat generating layer alone.

The fixing film 1 and fixing film 1A, as the second member, do not need to be in the endless form or rotational form. For example, they may be in the form of a web, which can be repeatedly rolled back and forth.

The pressing member 5 as the third member does not need to be in the form of a roller; for example, it may be in the form of a rotational belt, or the like.

A means for electromagnetically inducing the heat for controlling the temperature in the fixing nip N by generating heat may be provided on the pressuring member 5 side to supply the recording member P with thermal energy from the pressuring member 5 side.

The usage of a heating apparatus in accordance with the present invention is not limited to the usage as an image heating apparatus such as those in the preceding embodiments. It can be widely used as a thermal means, or an apparatus, for heating a wide range of objects. For example, it can be used an image heating apparatus for improving the surface properties, such as glossiness, of a resultant copy, by heating the recording medium on which an image is borne, an image heating apparatus for temporarily fixing an image, an image heating apparatus for drying an object, a thermal laminating apparatus, and the like.

While the invention has been described with reference to the structure disclosed herein, it is not confined to the details set forth, and this application is intended to cover such modifications or changes as may come within the purposes of the improvements or the scope of the following claims.

What is claimed is:

1. An image heating apparatus comprising:

a first member;

a second member slidable relative to said first member;

a third member for forming a nip with said first member with said second member disposed therebetween;

wherein said third member drives said second member and a recording material carrying an image is nipped and fed by the nip between said second member and said third member, and the image is heated; and pressure control means for controlling a pressure at said nip to set the pressure to a first pressure which is higher than zero and a second pressure which is higher than the first pressure;

wherein when said third member starts driving upon start of an image heating operation, said control means sets the pressure to the first pressure and then to the second pressure.

2. An apparatus according to claim 1, wherein a temperature of said second member rises by the start of the image heating operation.

3. An apparatus according to claim 1, wherein said control means changes the pressure from the first pressure to the second pressure a predetermined period after start of movement of said second member.

4. An apparatus according to claim 1, further comprising temperature detecting means for detecting a temperature, on the basis of which said control means switches the pressure from the first pressure to the second pressure.

5. An apparatus according to claim 4, wherein indicates that the temperature detected by said temperature detecting means is lower than a predetermined temperature before start of said second member, said control means switches the pressure from the first pressure to the second pressure when the temperature reaches the predetermined temperature.

6. An apparatus according to claim 4, wherein said temperature detecting means detects a temperature of said second member.

7. An apparatus according to claim 4, wherein said first member is a heater, and said temperature detecting means detects a temperature of said heater.

8. An apparatus according to claim 1, wherein a lubricant is provided between said first member and said second member.

9. An apparatus according to claim 1, further comprising urging means for urging said first member toward said third member, wherein the pressure at the nip changes by changing a position of a fulcrum of said urging means.

10. An apparatus according to claim 1, further comprising magnetic flux generating means for generating a magnetic flux by which eddy currents are produced in said second member, and heat is generated in said second member by the eddy currents.

11. An apparatus according to claim 10, wherein said first member holds said magnetic flux generating means, and supports said second member.

12. An apparatus according to claim 1, wherein said first member is a heater, which is provided with a heat generating element which generates heat upon electric power supply thereto.

13. An apparatus according to claim 1, wherein said second member is in the form of an endless film.

14. An apparatus according to claim 1, wherein said third member is a roller.

15. An apparatus according to claim 1, wherein the recording material has an unfixed image, which is fixed while the recording material is nipped and fed by the nip.

16. An apparatus according to claim 15, wherein said control means sets the pressure to the second pressure when the unfixed image is fixed.

17. An image heating apparatus comprising:

a first member;

a second member slidable relative to said first member;

a third member for forming a nip with said first member with said second member disposed therebetween;

wherein a recording material carrying an image is nipped and fed between said second member and said third member and the image is heated; and pressure control means for controlling a pressure at said nip to set the pressure to a first pressure and a second pressure which is higher than the first pressure;

wherein when said second member starts moving upon start of an image heating operation, said control means sets the pressure to the first pressure and then to the second pressure a predetermined period after start of movement of said second member.

18. An apparatus according to claim 17, further comprising a driving member for driving said second member.

19. An image heating apparatus comprising:

a first member;

a second member slidable relative to said first member;

a third member for forming a nip with said first member with said second member disposed therebetween;

wherein a recording material carrying an image is nipped and fed between said second member and said third member and the image is heated;

pressure control means for controlling a pressure at said nip to set the pressure to one of a first pressure and a second pressure which is higher than the first pressure;

wherein when said second member starts moving upon start of an image heating operation, said control means sets the pressure to the first pressure and then to the second pressure; and a temperature detecting means for detecting a temperature;

wherein said control means switches the pressure from the first pressure to the second pressure on the basis of the temperature detected by said temperature detecting means.

20. An apparatus according to claim 19, further comprising a driving member for driving said second member.

21. An image heating apparatus comprising:

a first member;

a second member slidable relative to said first member;

a third member for forming a nip with said first member with said second member disposed therebetween;

wherein a recording material carrying an image is nipped and fed between said second member and said third member and the image is heated;

pressure control means for controlling a pressure at said nip to set the pressure to one of a first pressure and a second pressure which is higher than the first pressure;

wherein when said second member starts moving upon start of an image heating operation, said control means sets the pressure to the first pressure and then to the second pressure; and urging means for urging said first member toward said third member;

wherein the pressure at the nip changes by changing a position of a fulcrum of said urging means.

22. An apparatus according to claim 21, further comprising a driving member for driving said second member.

* * * * *

UNITED STATES PATENT AND TRADEMARK OFFICE

CERTIFICATE OF CORRECTION

PATENT NO. : 6,347,201 B1
DATED : February 12, 2002
INVENTOR(S) : Tetsuya Sano et al.

Figure 9:
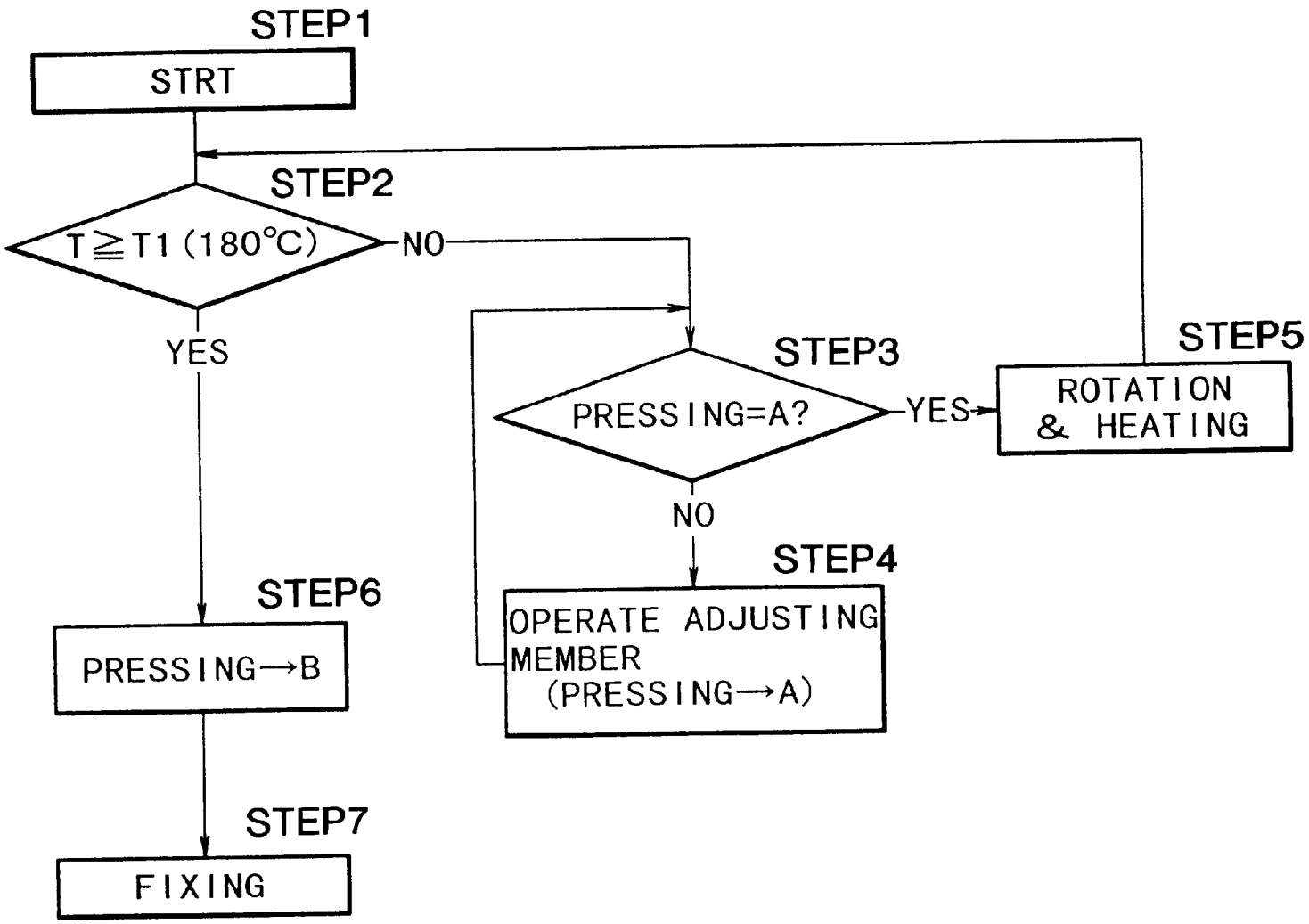
FIG. 9 is a flow chart which shows the control of the image heating apparatus.

It is certified that error appears in the above-identified patent and that said Letters Patent is hereby corrected as shown below:

Drawings,
SHEET NO. 6: Figure 7, “STRT” should read -- START --.
SHEET NO. 7: Figure 8, “STRT” should read -- START --.
SHEET NO. 8: Figure 9, “STRT” should read -- START --.

Column 1,
Line 30, “an” should read -- a --.

Column 2,
Line 7, “cessed.” should read -- cesses. --.
Line 48, “on” should read -- as --.
Line 61, “on aspect” should read -- an aspect --.

Column 3,
Line 66, “the” should read -- to --.

Column 4,
Line 46, “104C,” should read -- 104C is operated), --.

Column 7,
Line 42, “deviation.” should read -- deviating --.

Column 10,
Line 66, “over” should read -- oval --.

Column 11,
Line 53, “(Step 5 6).” should read -- (Steps 5, 6). --.
Line 61, “particularly,” should read -- particular, --.

Column 12,
Line 29, “Therefor,” should read -- Therefore, --.
Line 35, “(Step 5 6),” should read -- (Steps 5, 6), --.

Column 13,
Table 1: “R should read -- 8
15-25” 15-25 --.

UNITED STATES PATENT AND TRADEMARK OFFICE

CERTIFICATE OF CORRECTION

PATENT NO. : 6,347,201 B1
DATED : February 12, 2002
INVENTOR(S) : Tetsuya Sano et al.

It is certified that error appears in the above-identified patent and that said Letters Patent is hereby corrected as shown below:

Column 15,
Line 4, “an fixing” should read -- a fixing --.

Column 19,
Line 23, “an” should read -- as an --.
Line 64, “wherein indicates” should read -- wherein said temperature detecting means indicates --.

Signed and Sealed this

Eleventh Day of June, 2002

*Attest:*

*Attesting Officer*

JAMES E. ROGAN
*Director of the United States Patent and Trademark Office*